United States Patent [19]

Suzuki et al.

[11] Patent Number: 4,860,706

[45] Date of Patent: Aug. 29, 1989

[54] THRQTTLE BODY

[75] Inventors: Takio Suzuki; Kaneo Imamura, both of Obu, Japan

[73] Assignee: Aisan Kogyo Kabushiki Kaisha, Obu, Japan

[21] Appl. No.: 243,795

[22] Filed: Sep. 13, 1988

[30] Foreign Application Priority Data

| | | | |
|---|---|---|---|
| Sep. 14, 1987 | [JP] | Japan | 62-141311[U] |
| Sep. 14, 1987 | [JP] | Japan | 62-141312[U] |
| Sep. 14, 1987 | [JP] | Japan | 62-141313[U] |
| Sep. 14, 1987 | [JP] | Japan | 62-141314[U] |

[51] Int. Cl.[4] ..... F02M 9/08

[52] U.S. Cl. ..... 123/337; 123/319

[58] Field of Search ..... 123/337, 336, 442, 319, 123/396, 395, 400, 401, 399; 261/65; 251/305, 306

[56] References Cited

U.S. PATENT DOCUMENTS

| | | | |
|---|---|---|---|
| 3,620,195 | 11/1971 | Lamar | 123/337 |
| 4,344,396 | 8/1982 | Yamada | 123/337 |
| 4,356,801 | 11/1982 | Graham | 123/337 |
| 4,462,358 | 7/1984 | Ishida et al. | 123/337 |
| 4,474,150 | 10/1984 | Foley et al. | 123/337 |
| 4,480,367 | 11/1984 | Johnson et al. | 123/337 |
| 4,519,369 | 5/1985 | Kitamura | 123/337 |
| 4,561,158 | 12/1985 | Johnson et al. | 123/337 |

FOREIGN PATENT DOCUMENTS

| | | | |
|---|---|---|---|
| 50-141015 | 11/1975 | Japan | 123/319 |
| 51-23783 | 6/1976 | Japan | 123/319 |
| 61-121738 | 6/1986 | Japan | 123/319 |
| 61-137858 | 8/1986 | Japan | 123/319 |

*Primary Examiner*—Raymond A. Nelli

*Attorney, Agent, or Firm*—Dennison, Meserole, Pollack & Scheiner

[57] ABSTRACT

A throttle valve comprising a first outer peripheral portion linearly contacting an inner wall of an intake passage at a predetermined throttle angle and a second outer peripheral portion formed in the vicinity of a throttle shaft in such a manner as to gently continue from the first outer peripheral portion and not contacting the inner wall at the predetermined throttle angle. With this arrangement, as there is defined a space between the second outer peripheral portion and the inner wall in the vicinity of the throttle shaft, the generation of scuffing and biting of the throttle valve against the inner wall may be prevented. Further, as the first outer peripheral portion of the throttle valve linearly contacts the inner wall at the closing position, the leakage of suction air upon full closing of the throttle valve may be suppressed. Further, a drainage structure for a motor for opening and closing the throttle valve and a bearing support structure for rotatably supporting the throttle shaft with respect to a throttle housing are also disclosed.

6 Claims, 11 Drawing Sheets

THROTTLE BODY

BACKGROUND OF THE INVENTION

1. Field of the Invention

The present invention generally relates to a throttle body for controlling a suction air quantity flowing in a suction passage. More specifically, a first aspect of the present invention relates to an improvement in shape of a throttle valve to be provided in the throttle body. A second aspect of the present invention relates to an improvement in structure of the throttle body for restricting a rotative angle of the throttle valve to be operated by a motor. A third aspect of the present invention relates to an improvement in drainage structure for the motor, in the throttle body. Finally, a fourth aspect of the present invention relates to an improvement in mount structure of a throttle shaft for rotatably mounting the throttle valve.

2. Related Art

In relation to the first aspect of the present invention, a known throttle valve has a shape substantially corresponding to a sectional shape of a suction passage. However, such a throttle valve has a problem that there occurs scuffing or biting with respect to an inner wall of the suction passage in the vicinity of a throttle shaft. Japanese Utility Model Laid-Open Publication No. 61-137858 has proposed a technique for solving this problem, in which a throttle valve has an elliptical shape such that a minor axis thereof in the axial direction of the throttle shaft is smaller than an inner diameter of the suction passage. Another type throttle valve has a substantially elliptical shape having opposite strightly chamfered portions in the vicinity of the throttle shaft, so as to prevent the scuffing or biting of the throttle valve in the vicinity of the throttle shaft.

In the first type throttle valve as mentioned above, there are disadvantageously defined arcuate spaces between the outer periphery of the throttle valve and the inner wall of the suction passage since the elliptical throttle valve is closed in the suction passage having a circular cross section. As a result, leakage of suction air around the throttle valve upon full closing thereof cannot be suppressed. In another respect, if the elliptical throttle valve is deformed by heat into a substantially circular shape, it will scuff the inner wall of the suction passage in the vicinity of the throttle shaft. Further, in mounting the elliptical throttle valve into the suction passage having a circular cross section, the outer periphery of the throttle valve contacts the inner wall only at two points, causing a difficulty of accurate positioning of the throttle valve with respect to the inner wall.

In the second type throttle valve as mentioned above, the straight chamfered portion does not gradually continue from the curved outer periphery of the throttle valve, and there tends to generate burr at the border of the chamfered portion and the curved outer periphery of the throttle valve upon formation of the chamfered portion. This burr causes the scuffing or biting to the inner wall of the suction passage.

In relation to the second aspect of the present invention, a throttle shaft in a conventional throttle body for mounting a throttle valve extends at its one end portion out of a throttle housing defining a suction passage therein, and an arm member is mounted on the extended portion of the throttle shaft. The arm member is provided with adjust screws abuttable against a stopper fixed to the throttle housing. Alternatively, the throttle housing is provided with the adjust screws abuttable against the stopper formed at the arm member. Thus, a rotational angle range of the throttle valve is restricted. Such a structure wherein the adjust screws are located outside the throttle housing is disclosed in Japanese Utility Model Publication No. 51-23783, for example.

In the conventional structure as mentioned above, if the one end portion of the throttle shaft is exposed outside the throttle housing, there will be generated no problem. However, if the one end portion of the throttle shaft is not exposed outside the throttle housing, e.g., in the case that the throttle shaft is provided at its both end portions with a throttle sensor and a valve driving motor, a space cannot be defined for mounting the arm member and locating the adjust screws at the arm member or the throttle housing. Accordingly, it is difficult to construct the afore-mentioned structure. If the afore-mentioned structure is applied to the latter case, there is generated a problem that a foreign matter such as water or dust enters the throttle sensor and the driving motor.

In relation to the third aspect of the present invention, a known drainage structure for the motor is disclosed in Japanese Patent Laid-Open Publication No. 61-121738, for example. The conventional drainage structure includes a drain hole formed through a motor frame and a drain tube connected through a connecting member to the drain hole, so as to prevent entry of water into the motor and also expel the water having entered the inside of the motor to the outside.

In the above drainage structure, when the drain hole having a small cross section is employed, the entry of water may be effectively suppressed, but once the water enters the inside of the motor, it is hard to expel. In contrast, when the drain tube having a large cross section is employed, the water having entered the inside of the motor may be effectively expelled, but the water is easy to enter. Thus, it is hard to satisfy both water resistance and drainage performance in the conventional drainage structure.

Further, in order to promote the drainage performance, a vent hole is generally formed at an upper position of the frame. However, there is a possibility that water will enter the inside of the motor from the vent hole.

Moreover, as the above drainage structure includes the independent drainage parts such as the connecting member and the drain tube, there is also a possibility of these parts being released or damaged because of aged deterioration or external force, causing a reduction in water resistance and drainage performance.

Although a complete sealing structure of the motor may be replaced by the drainage structure, the sealing structure is complicated to cause an increase in cost. Further, in the event that the sealing structure is damaged to allow the entry of water into the motor, the water remains still in the motor to cause a reduction in motor function.

In relation to the fourth aspect of the present invention, a conventional throttle shaft supporting structure is shown in FIG. 23. As shown in FIG. 23, a throttle shaft 412 is fixed to a throttle shaft 414, and the throttle shaft 414 is axially movably supported to a throttle housing 410.

Such an axial movement of the throttle shaft is prevented by a technique disclosed in Japanese Utility Model Laid-Open Publication No. 50-141015, for example. In one example of the technique, ball bearings are press-fitted to the throttle shaft, and dust covers are provided on the outer side of the ball bearings. The dust covers are biased by springs. In another example of the technique, a ball bearing is press-fitted to one end portion of the throttle shaft, and an outer ring of the ball bearing is fixed to the throttle housing by a fixing plug.

Although the above technique can prevent the axial movement of the throttle shaft to some extent, there remains a clearance in the ball bearing. Generally in a ball bearing, an axial clearance is remarkably larger than a radial clearance. Therefore, if resonance of a throttle rotating member due to vibration of an internal combustion engine is generated in the axial direction of the throttle shaft, a rolling surface of the ball bearing is greatly damaged to cause a trouble in operation of the throttle valve.

SUMMARY OF THE INVENTION

It is an object of the first aspect of the present invention to provide a throttle valve which eliminates the scuffing or biting, and suppresses the leakage of suction air at its full closed position, and may be easily mounted at a precise position in the suction passage.

According to the first aspect of the present invention, there is provided a throttle valve comprising a first outer peripheral portion linearly contacting an inner wall of an intake passage at a predetermined throttle angle and a second outer peripheral portion formed in the vicinity of a throttle shaft in such a manner as to gently continue from the first outer peripheral portion and not contacting the inner wall at the predetermined throttle angle.

With this arrangement, as there is defined a space between the second outer peripheral portion and the inner wall in the vicinity of the throttle shaft, the generation of scuffing and biting of the throttle valve against the inner wall may be prevented. Further, as the first outer peripheral portion of the throttle valve linearly contacts the inner wall at the closing position, the leakage of suction air upon full closing of the throttle valve may be suppressed. Further, in mounting the throttle valve into the suction passage, the throttle valve may be easily positioned relative to the inner wall, and especially, it is prevented from being shifted in the axial direction of the throttle shaft. Moreover, as the first and second outer peripheral portions are gently continued with no burrs, the generation of scuffing and biting of the burrs may be also prevented.

It is an object of the second aspect of the present invention to provide a throttle body which may properly restrict a rotational angle range of a throttle valve without entry of a foreign matter into a throttle sensor and a driving motor.

According to the second aspect of the present invention, there is provided a throttle body comprising a throttle housing defining a suction passage therein, a throttle shaft extending across the suction passage to the outside of the throttle housing at at least one end thereof and being rotatably supported to the throttle housing, a throttle valve fixed to the throttle shaft for opening and closing the suction passage, a sectoral driven gear fixed to the one end portion of the throttle shaft outside the throttle housing, said driven gear having a pair of stopper end surfaces, a motor fixed to the throttle housing and having an output shaft mounting a drive gear thereon meshing with the driven gear of the throttle shaft, a gear receiving chamber closely defined by the motor and the throttle housing for receiving the drive gear and the driven gear, a pair of adjust screws threadedly inserted through a wall of the gear receiving chamber and being abuttable against the pair of stopper end surfaces of the sectoral driven gear, wherein when the motor is driven to rotate the driven gear through the drive gear to a full open position or a full closed position, further rotation of the throttle valve exceeding the full open position or the full closed position is restricted.

With this arrangement, when the motor is driven to rotate the output shaft and thereby fully open or close the throttle valve through the drive gear and the driven gear, either of the stopper end surfaces of the sectoral driven gear abuts against an end of the corresponding one of the adjust screws, thereby setting the full open position and the full closed position and restricting a proper operational quantity of the throttle valve. Further, as the adjust screws are threadedly inserted through the wall of the gear receiving chamber, the enclosed condition of the gear receiving chamber is hardly hindered, thereby preventing the entry of the foreign matter into the motor.

It is an object of the third aspect of the present invention to provide a drainage structure for a motor for driving a throttle valve in a throttle body which structure is improved in water resistance and drainage performance.

According to the third aspect of the present invention, there is provided a throttle body comprising a throttle housing defining a suction passage therein, a throttle shaft extending across the suction passage and being rotatably supported to the throttle housing, a throttle valve fixed to the throttle shaft for opening and closing the suction passage, a motor fixed to the throttle housing for rotating the throttle shaft, a gear receiving chamber defined by the motor and the throttle housing, a first drain hole formed at a lower position of the motor to communicate the inside of the motor with the gear receiving chamber, a first vent hole formed at a position higher than the first drain hole to communicate the inside of the motor with the gear receiving chamber, a second drain hole formed at a bottom of an engaged portion between the motor and the throttle housing to communicate the gear receiving chamber with the atmosphere, and a second vent hole formed at a position higher than the second drain hole to communicate the gear receiving chamber with the atmosphere.

With this arrangement, the inside of the motor is communicated through the first drain hole and the first vent hole to the gear receiving chamber, while the gear receiving chamber is communicated through the second drain hole and the second vent hole to the atmosphere. Accordingly, even if the outside water enters the gear receiving chamber through the second drain hole or the second vent hole, the water is prevented from entering the inside of the motor owing to the second drain hole and the second vent hole. Even if the water in the gear receiving chamber enters the inside of the motor, it is quickly expelled through the first drain hole to the gear receiving chamber owing to the first vent hole, and is then quickly expelled through the second drain hole to the outside of the gear receiving chamber owing to the second vent hole communicated with the atmosphere. Thus, the drainage structure of the present invention is improved in water resistance and drainage performance.

Furthermore, as any independent parts for drainage are not necessary in the drainage structure of the present invention, there is no possibility of such parts being released or damaged, thereby preventing a reduction in function of the motor and improving the durability of the motor.

It is an object of the fourth aspect of the present invention to provide a throttle shaft supporting structure which may prevent the axial movement of the throttle shaft and eliminate looseness in the bearing.

According to the fourth aspect of the present invention, there is provided a throttle body comprising a throttle housing defining a suction passage therein, a throttle shaft extending across the suction passage and being rotatably supported to the throttle housing, a pair of bearings for rotatably supporting the throttle shaft to opposite wall portions of the throttle housing, each said bearing having an inner ring loosely fitted to the throttle shaft and an outer ring loosely fitted to the throttle housing, a throttle valve fixed to the throttle shaft for opening and closing the suction passage, a pair of abutment portions provided at opposite end portions of the throttle shaft in such a manner as to abut against the inner rings of the bearings, a pair of engagement portions provided at the opposite wall portions of the throttle housing in such a manner as to engage the outer rings of the bearings, a spring interposed between at least one of the outer rings and the engagement portion opposed thereto, and an adjusting means for adjusting at least one of the abutment portions or at least one of the engagement portions in the axial direction of the throttle shaft.

With this arrangement, when a set load of the spring is adjusted by the adjusting means, the spring axially urges the bearing directly abutting thereagainst to thereby normally bias the throttle shaft. Accordingly, the axial movement of the throttle shaft may be prevented, and the looseness in the bearings may be eliminated.

The invention will be more fully understood from the following detailed description and appended claims when taken with the drawings.

DETAILED DESCRIPTION OF THE PREFERRED EMBODIMENTS

Figure 1A:
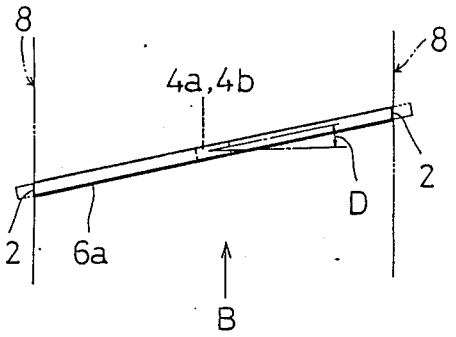
FIG. 1A is a side view of a throttle valve material to be cut in a first cutting stage according to the first aspect of the present invention.
Figure 1B:
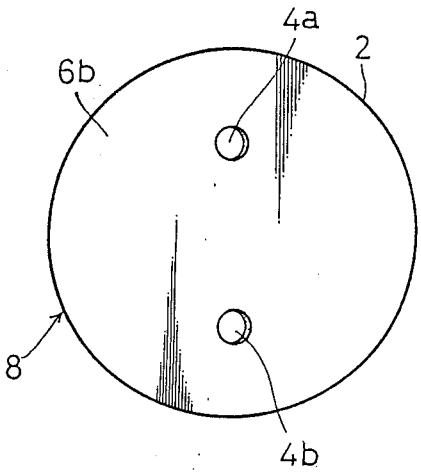
FIG. 1B is a bottom plan view of the throttle valve material as viewed from arrow B in FIG. 1A.

FIGS. 1A to 3B show a preferred embodiment according to the first aspect of the present invention. Referring first to FIG. 1A, a substantially disc-like material 6*a* having holes 4*a* and 4*b* for mounting a throttle valve 6 to a throttle shaft 16 by means of screws 18*a* and 18*b* is cut at its outer periphery by a cutting tool along a cylindrical plane 8 under the condition such that the substantially disc-like material 6 is inclined at an angle D from a plane perpendicular to an axis of the cylindrical plane 8 and that a line connecting both the holes 4*a* and 4*b* is perpendicular to the axis of the cylindrical plane 8. Referring to FIG. 1B as viewed from the arrow B in FIG. 1A, reference numeral 6*b* designates a throttle valve material cut from the substantially disc-like material 6*a*. The throttle valve material 6*b* is formed with an outer peripheral portion 2 adapted to linearly contact an inner wall 22 of a suction passage 20. The throttle valve material 6*b* is circular as viewed from the arrow B in FIG. 1A.

Figure 2A:
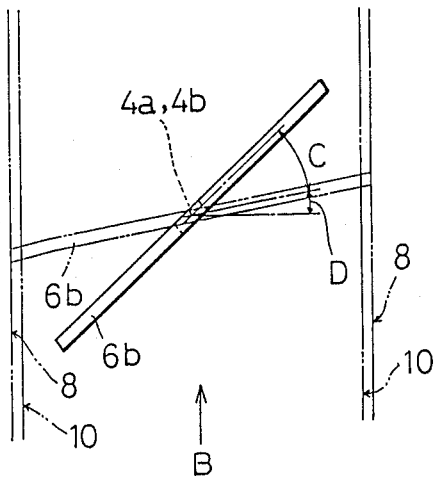
FIG. 2A is a side view of the throttle valve material to be cut in a second cutting stage according to the first aspect of the present invention.
Figure 2B:
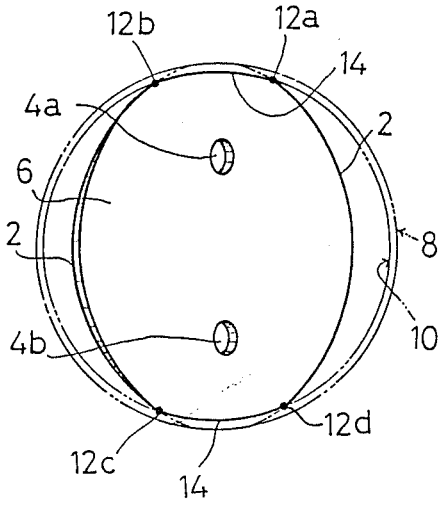
FIG. 2B is a bottom plan view of the throttle valve material as viewed from arrow B in FIG. 2A.

Referring to FIG. 2A, the throttle valve material 6*b* is further cut at its outer periphery by a cutting tool along a cylindrical plane 10 having an inner diameter slightly smaller than that of the cylindrical plane 8 under the condition that the throttle valve material 6*b* is inclined at an angle (C+D) from the plane perpendicular to the axis of the cylindrical plane 10 and that the line connecting both the holes 4*a* and 4*b* is perpendicular to the axis of the cylindrical plane 10. Referring to FIG. 2B as viewed from the arrow B in FIG. 2A, reference numeral 6 designates a throttle valve cut from the throttle valve material 6*b*. The throttle valve 6 is formed with outer peripheral portions 14 at opposite positions in the vicinity of an axis of the throttle shaft 16, namely, in the vicinity of an extension of the line connecting the holes 4*a* and 4*b*. The outer peripheral portions 14 gently continue from the outer peripheral portions 2 and they are disposed so as not to contact the inner wall 22 of the suction passage 20. That is, the outer periphery of the throttle valve 6 intersects the cylindrical plane 10 at four points 12*a*, 12*b*, 12*c* and 12*d* to form the opposed outer peripheral portions 14 between the points 12*a* and 12*b* and between the points 12*c* and 12*d*, and the residual portion of the outer periphery of the throttle valve 6 forms the outer peripheral portions 2 between the points 12*b* and 12*c* and between the points 12*a* and 12*d*. As the outer peripheral portions 2 gradually continue from the outer peripheral portions 14, there is no possibility that burrs are generated at the points 12*a*, 12*b*, 12*c* and 12*d*.

Figure 3A:
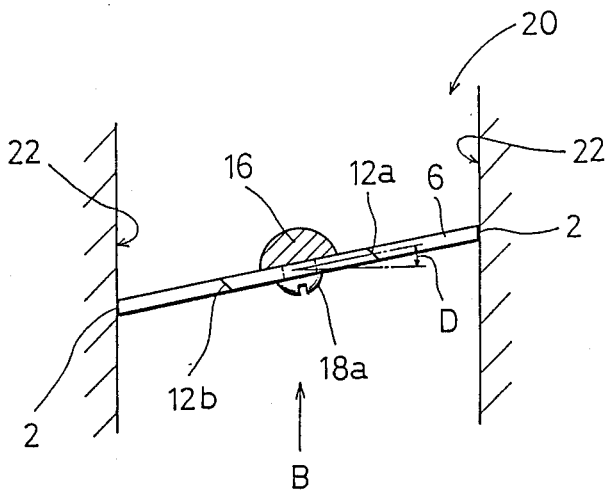
FIG. 3A is a sectional side view of a throttle valve installed in a suction passage according to the first aspect of the present invention.
Figure 3B:
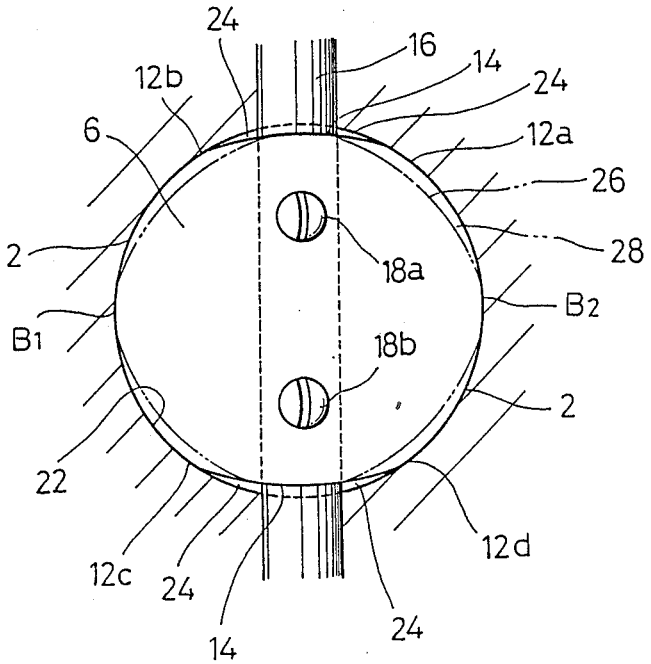
FIG. 3B is a bottom plan view of the throttle valve installed in the suction passage as viewed from arrow B in FIG. 3A.

Referring to FIGS. 3A and 3B, the throttle shaft 16 is rotatably supported to the inner wall 22 of the suction passage 20 having a circular cross section in such a manner as to extend in perpendicular relationship to the axis of the suction passage 20. In mounting the throttle valve 6 into the suction passage 20 at the inclined angle D as shown in FIG. 3A, the outer peripheral portions 2 of the throttle valve 6 linearly closely contact the inner wall 22 between the points 12*b* and 12*c* and between the points 12*a* and 12*d*, while the outer peripheral portions 14 of the throttle valve 6 in the vicinity of the throttle shaft 16 are spaced apart from the inner wall 22 between the points 12*a* and 12*b* and between the points 12*c* and 12*d* to define gaps 24, so that there is no possibility of the throttle valve 6 scuffing and biting the inner wall 22 upon rotation of the throttle valve 6.

Referring to FIG. 3B, a long and two short dashes line 26 shows an outer periphery of the conventional elliptical throttle valve mounted in the suction passage 20 with the spaces 24 defined. It is understood that the outer periphery 26 contacts the inner wall 22 at opposite points B1 and B2 and that arcuate spaces 28 are defined between the outer periphery 26 and the inner wall 22. On the contrary, according to the first aspect of the present invention, there are defined the limited spaces 24 between the outer periphery of the throttle valve 6 and the inner wall 22 in the vicinity of the throttle shaft 16. Accordingly, when the throttle valve 6 is in the full closed position, leakage of suction air around the throttle valve 6 may be suppressed.

Further, in mounting the conventional elliptical throttle valve 26 in the suction passage 20, it is difficult to precisely position the throttle valve with respect to the inner wall 22 because the outer periphery of the throttle valve contacts the inner wall 22 only at the two points B1 and B2. Particularly, it is required to precisely position the throttle valve so as not to be slipped in the axial direction of the throttle shaft 16. On the contrary, in mounting the throttle valve 6 of the present invention in the suction passage 20, the throttle valve 6 may be easily precisely positioned only by contacting the outer periphery of the throttle valve 6 with the inner wall 22 since the arcuate outer peripheral portions 2 formed between the points 12*b* and 12*c* and between the points 12*a* and 12*d* are allowed to contact the inner wall 22. The holes 4*a* and 4*b* formed through the throttle valve 6 have a diameter substantially equal to an outer diameter of screws 18*a* and 18*b* to be engaged with the holes 4*a* and 4*b*, respectively. Accordingly, under the condition that the outer periphery of the throttle valve 6 contacts the inner wall 22, the screws 18*a* and 18*b* are threadedly engaged with the holes 4*a* and 4*b*, respectively, thereby positioning the throttle valve 6 with respect to the inner wall 22 at an accurately circumferential position.

Figure 4:
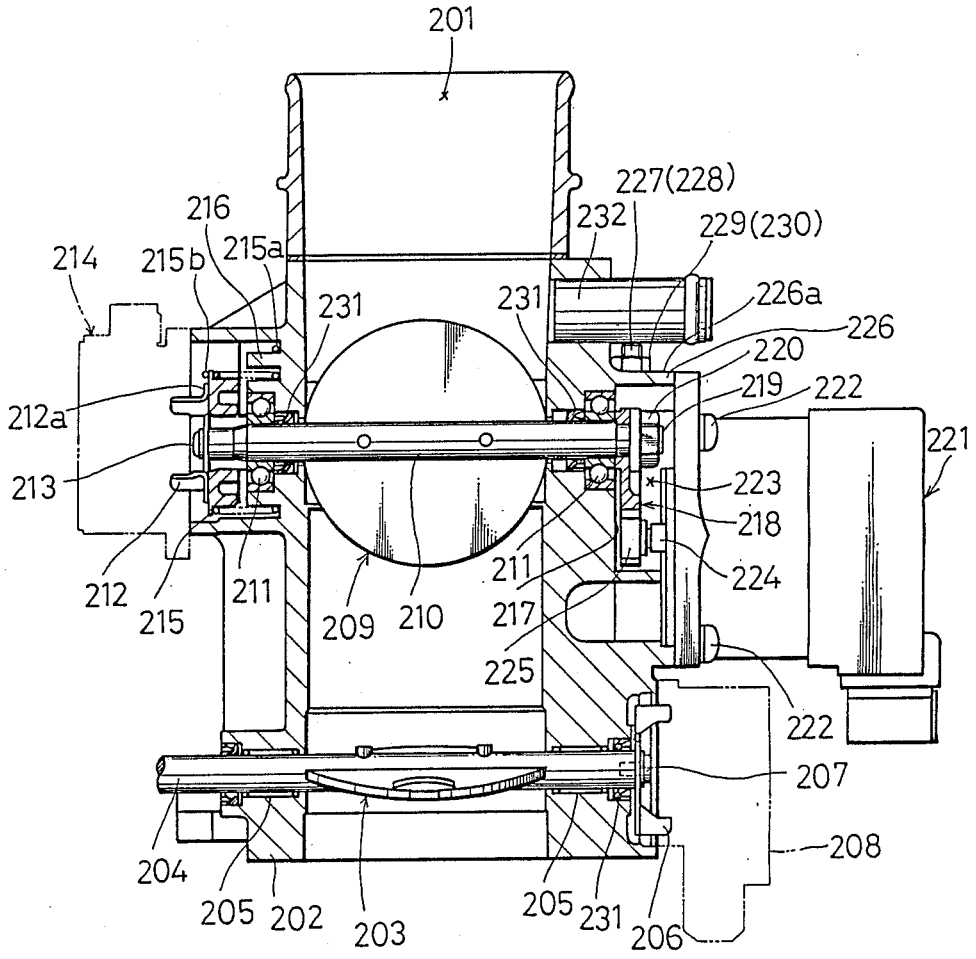
FIG. 4 is a sectional view of the throttle body according to the second aspect of the present invention.
Figure 5:
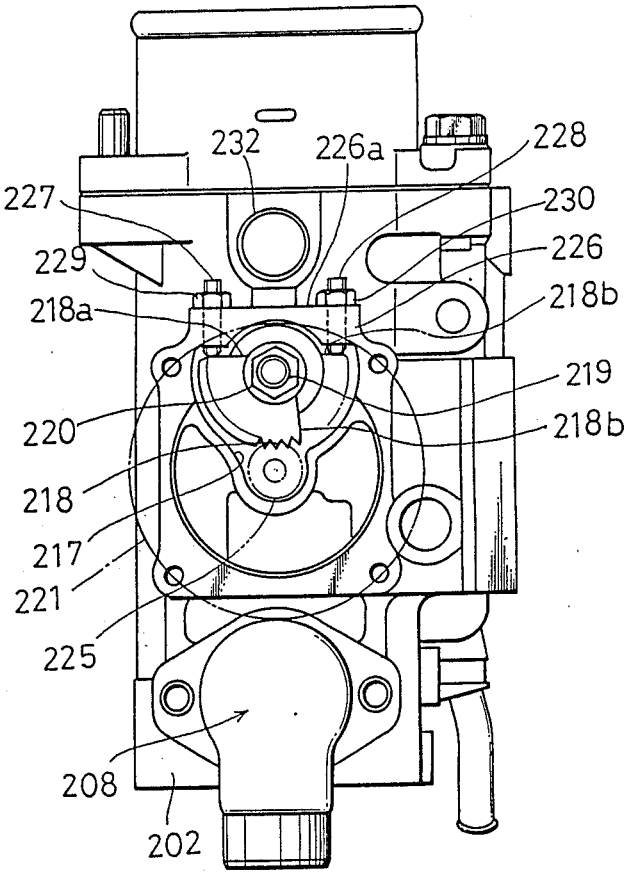
FIG. 5 is a side view of the throttle body shown in FIG. 4 with the motor removed.

FIGS. 4 and 5 show a preferred embodiment according to the second aspect of the present invention. The preferred embodiment is directed to a throttle body designed to carry out traction control. The throttle body includes a throttle main valve 203 serving as a usual throttle valve and a throttle sub valve 209 normally fully opened. When the main valve 203 is rapidly fully opened, the sub valve 209 is closed to an idling angle (a fully closed position). The main valve 203 is located at a lower portion of a substantially cylindrical throttle housing 202 defining a suction passage 201 therein. The main valve 203 is fixed to a throttle shaft 204 rotatably supported at its both end portions through a pair of needle bearings 205 to the throttle housing 202. Both ends of the throttle shaft 204 projects outwardly from the throttle housing 202, one end (left end as viewed in FIG. 4) of which being connected to an accelerator linkage, while the other end (right end as viewed in FIG. 4) being connected to a sensor rotor 206 by a locking screw 207. A throttle sensor 208 is provided outside the throttle housing 202 for detecting an opening angle of the main valve 203 according to the rotation of the sensor rotor 206. The main valve 203 is normally disposed in the fully closed position or at the idling angle, and it is rotated to a desired opening angle by the operation of an accelerator pedal (not shown).

The sub valve 209 is located upstream of the main valve 203 in the suction passage 201, and it is fixed to a throttle shaft 210 rotatably supported at its both end portions through a pair of ball bearings 211 to the throttle housing 202. Both ends of the throttle shaft 210 for the sub valve 209 project outwardly from the throttle housing 202, one end (left end as viewed in FIG. 4) of which being connected to a sensor rotor 212 having a mounting member 212*a* by a locking screw 213. A throttle sensor 214 is provided outside the throttle housing 202 for detecting an opening angle of the sub valve 209 according to the rotation of the sensor rotor 212.

A return spring 215 such as a coil spring is interposed between the sensor rotor 212 and the throttle housing 202 in such a manner as to be coaxial with the throttle shaft 210. One end 215*a* of the return spring 215 is engaged with a stopper 216 projecting from the throttle housing 202, while the other end 215*b* is engaged with a part of a mounting member 212*a* of the sensor rotor 212. Thus, the return spring 215 acts to normally bias the throttle sub valve 209 to the fully open position.

The throttle housing 202 is formed at its outside portion around the other end of the throttle shaft 210 (the right end as viewed in FIG. 4) with a recess 217 for receiving a sectoral driven gear 218 and a drive gear 225.

The driven gear 218 is mounted on the other end of the throttle shaft 210 in such a manner that the driven gear 218 is formed with an elongated hole to be fitted with a corresponding end of the throttle shaft 210, and a lock nut 220 is threadedly engaged with a threaded end portion 219 of the throttle shaft 210.

A stepping motor 221 for driving the throttle sub valve 209 is mounted to the throttle housing 202 by plural lock nuts 222 in such a manner as to close the recess 217 and define a substantially enclosed space 223. The stepping motor 221 has an output shaft 224 mounting the drive gear 225 meshing with the driven gear 218. Thus, when the motor 221 is rotated normally or reversely, the torque of the motor 221 is transmitted through the drive gear 225 and the driven gear 218 to the throttle shaft 210, thereby opening or closing the throttle sub valve 209. More specifically, when the motor 221 is rotated in the normal direction, the drive gear 225 is rotated in the same direction, and the driven gear 218 is therefore rotated counterclockwise as viewed in FIG. 5 to thereby rotate the throttle sub valve 209 to the full closing position. On the contrary, when the motor 221 is rotated reversely under the condition where the sub valve 209 is in the full closed position, the driven gear 218 is rotated clockwise as viewed in FIG. 5 through the driven gear 225, thereby rotating the sub valve 209 to the full open position.

As shown in FIG. 5, a pair of adjust screws 227 and 228 are vertically threadedly engaged with an upper wall portion 226*a* of a wall 226 of the recess 217, and a pair of lock nuts 229 and 230 are threadedly engaged with the adjust screws 227 and 228 at their upper portions, respectively, to abut against the upper wall portion 226*a* of the wall 226.

The lower ends of the adjust screws 227 and 228 extend into the space 223, and either of the lower ends is adapted to abut against an end surface 218*a* or 218*b* of the driven gear 218. That is, when the throttle sub valve 209 is in the full open position, the lower end of the first adjust screw 227 (left one as viewed in FIG. 5) abuts against the one end surface 218*a* of the driven gear 218 as shown by a solid line in FIG. 5. On the contrary, when the throttle sub valve 209 is in the full closed position, the lower end of the second adjust screw 228 (right one as viewed in FIG. 5) abuts against the other end surface 218*b* of the driven gear 218 as shown by a long and two short dashes line in FIG. 5. Accordingly, an operational range of the throttle sub valve 209 is properly adjusted by adjusting the adjust screws 227 and 228. Reference numerals 231 and 232 shown in FIG. 4 designate a seal ring and a fast idle air inlet pipe, respectively.

In operation, when the throttle main valve 203 is rapidly fully opened, the motor 221 is rotated in the normal direction to close the throttle sub valve from the full open condition to the full closed position or the idling position, thereby effecting traction control.

At this time, the full closed position of the throttle sub valve 209 is restricted since the lower end of the second adjust screw 228 abuts against the end surface 218*b* of the driven gear 218 as shown by the long and two short dashes line in FIG. 5, thereby preventing further closing operation of the throttle sub valve 209. Accordingly, a suction air quantity flowing downstream of the sub valve 209 in the suction passage 201 may be restricted to a quantity substantially equal to an idling air quantity, and simultaneously, it is possible to prevent the generation of scuffing and biting of the sub valve 209 against the wall surface of the suction passage 201 due to further closing operation of the sub valve 209.

On the contrary, when the throttle main valve 203 is stopped in its opening operation or it is operated to close, the motor 221 is rotated reversely to drive the sub valve 209 from the full closed position to the full open position. At this time, the full open position of the throttle sub valve 209 is restricted since the lower end of the first adjust screw 227 abuts against the end surface 218*a* of the driven gear 218 as shown by the solid line in FIG. 5, thereby preventing further opening operation of the sub valve 209. Accordingly, the direction of the sub valve in the full open position is made parallel to the direction of suction air flow in the suction passage 201, thereby minimizing an air pressure loss by the sub valve 209 and simultaneously preventing an increase in the air pressure loss due to further opening operation of the sub valve 209.

When the adjust screw 227 or 228 abuts against the driven gear 218 so as to rotate the throttle sub valve 209 to the full open position or the full closed position by driving the stepping motor 221, there is a possibility that the motor 221 will be rendered out of condition because of impact of such abutment. To eliminate the possibility, when fully closing the throttle sub valve 209, the motor 221 is controlled by a computer to be driven at high speed until a timing just before the full closing position, e.g., until a timing before five steps, and driven at low speed after five steps, so that the end surface 218*b* of the driven gear 218 may gently abut against the second adjust screw 228. On the other hand, when fully opening the throttle sub valve 209, the motor 221 is deenergized at a timing just before the full open position, so that the end surface 218*a* of the driven gear 218 may gently abut against the first adjust screw 227 by the elastic force of the return spring 215.

FIGS. 6 to 9 show a preferred embodiment according to the third aspect of the present invention, and FIGS. 10 to 21 show various modifications of the preferred embodiment.

Figure 6:
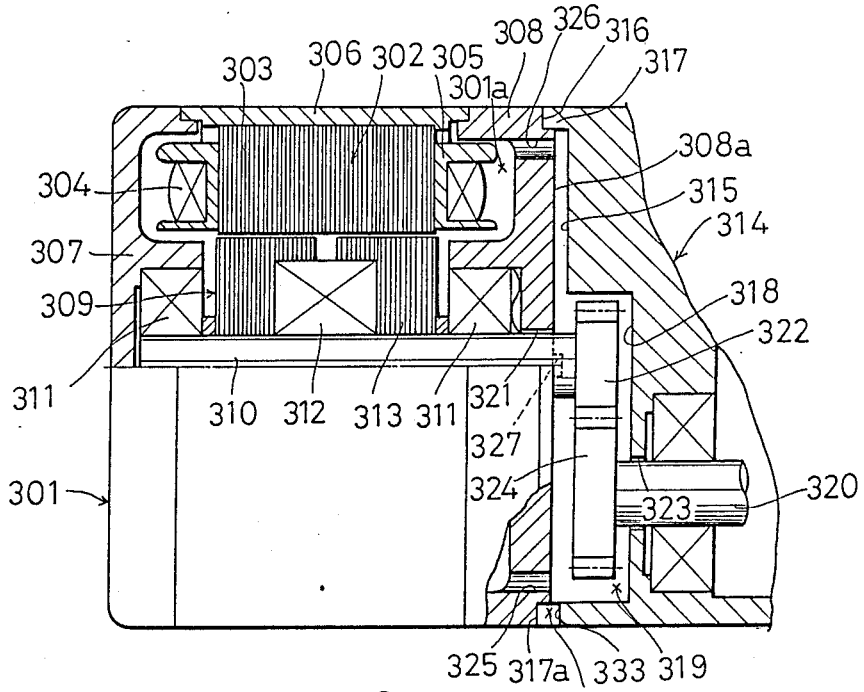
FIG. 6 is a partially sectional side view of the drainage structure according to the third aspect of the present invention.

Referring to FIG. 6 which shows a step motor 301 mounted to a throttle housing 314, reference numeral 302 designates a stator of the motor 301 including a stator core 303, a stator coil 304 wound around the core 303, and an insulator 305 interposed between the core 303 and the coil 304. The stator 302 is fixedly inserted (e.g., press-fitted) into a cylindrical frame 306, and is closed at its front and rear end by an end cap 307 and an end cover 308.

Reference numeral 309 designates a rotor surrounded by the stator 302. The rotor 309 has an output shaft 310 rotatably supported by a pair of bearings 311 to the end cap 307 and the end cover 308. The rotor 309 includes a magnet 312 and a rotor core 313 fixed on the output shaft 310. The end cap 307 and the end cover 308 are connected to each other by a suitable number of through-bolts (not shown) at the outer peripheral portion thereof.

The end cover 308 fixed to the motor 301 is mounted to a mount surface 315 of the throttle housing 314 by means of known screw means. The output shaft 310 of the motor 301 is disposed horizontally with respect to the throttle housing 314.

Figure 7:
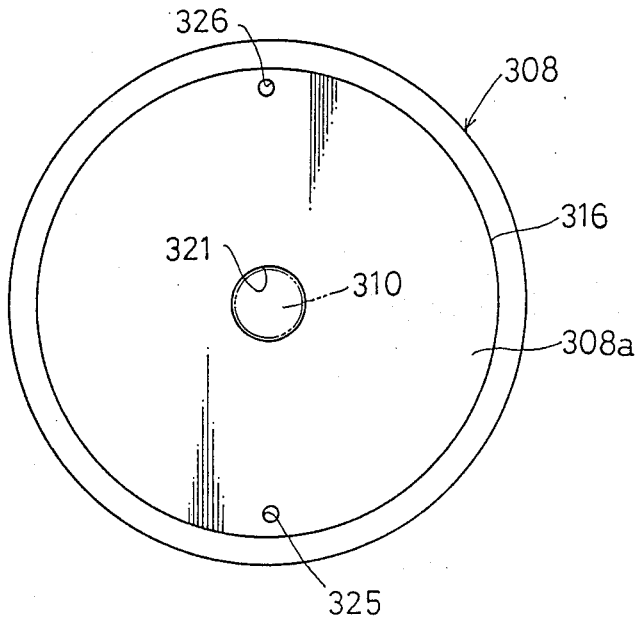
FIG. 7 is an elevational view of a mount surface of an end cover shown in FIG. 6.

As shown in FIG. 7, a mount surface 308*a* of the end cover 308 to be mounted to the mount surface 315 of the throttle housing 314 is formed with a circular shoulder 316, while the mount surface 315 of the throttle housing 314 is formed with a circular flange 317 to be engaged with the shoulder 316 of the end cover 308. As shown in FIG. 6, the mount surface 315 of the throttle housing 314 is also formed with a recess 318 for receiving a gear train 322 and 324. Under the mounted condition where the shoulder 316 of the end cover 308 is engaged with the flange 317 of the throttle housing 314, there is defined a substantially enclosed space 319.

The output shaft 310 of the motor 301 extends at its one end portion through a shaft hole 321 formed through the end cover 308 into the space 319, and the driven gear 322 is fixed at the one end of the output shaft 310. On the other hand, a throttle shaft 320 extends at its one end portion through a shaft hole 323 formed through the throttle housing 314 into the space 319, and the driven gear 324 meshing with the drive gear 322 is fixed at the one end of the throttle shaft 320. Thus, a driving force of the motor 301 is transmitted through the drive gear 322 and the driven gear 324 to the throttle shaft 320.

The end cover 308 is formed at its bottom portion with a drain hole 325 for draining the inside 301*a* of the motor 301, and is also formed at its top portion with a vent hole 326 for assisting the drainage. The drain hole 325 and the vent hole 326 communicate the inside 301*a* of the motor 301 with the space 319.

The circular engaged portion between the flange 317 of the throttle housing 314 and the shoulder 316 of the end cover 308 is formed at its bottom portion with a drain hole 332 for draining the space 319, and is also formed at its side portion (See FIG. 8) with a vent hole 327 communicated with the atmosphere for assisting the drainage.

Figure 8:
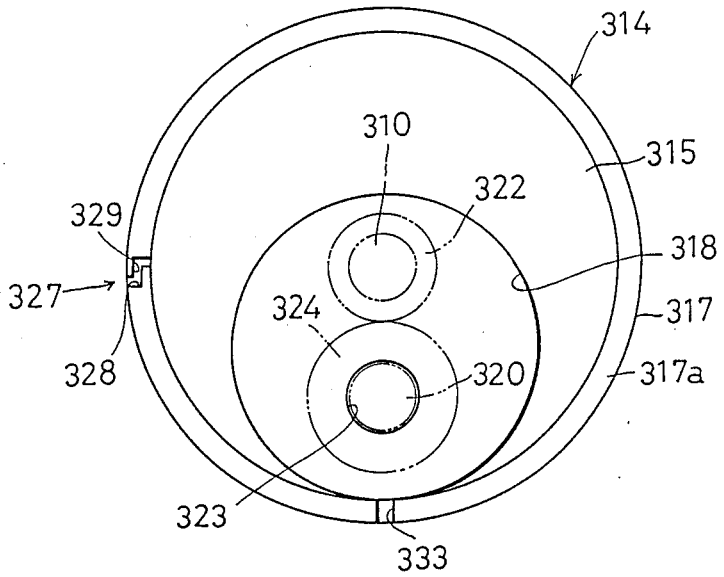
FIG. 8 is an elevational view of a mount surface of a throttle housing shown in FIG. 6.
Figure 9:
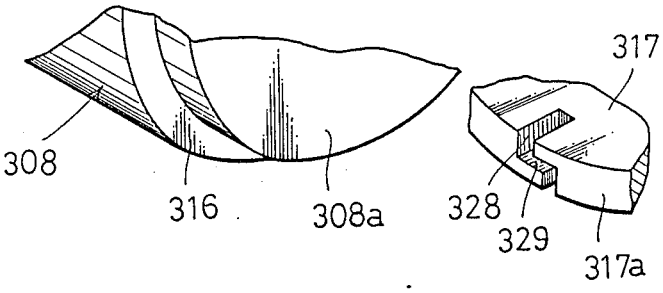
FIG. 9 is an exploded perspective view of an essential part shown in FIG. 6.

As shown in FIGS. 8 and 9, the vent hole 327 at the side portion of the circular engaged portion is formed by a substantially Z-shaped groove 328 having a stepped portion 329 formed on an end surface 317*a* of the flange 317 and by the mount surface 308*a* of the end cover 308 to be fitted to the end surface 317*a* of the flange 317. Similarly, the drain hole 332 at the bottom portion of the circular engaged portion is formed by a straight groove 333 formed on the end surface 317*a* of the flange 317 and by the mount surface 308*a* of the end cover 308. The grooves 328 and 333 are formed by metal molding of the throttle housing 314.

In the drainage structure of the motor 301 as mentioned above, as the inside 301*a* of the motor 301 is communicated through the drain hole 325 and the vent hole 326 to the space 319, and the space 319 is communicated through the vent hole 327 and the drain hole 332 to the atmosphere, it is possible to prevent outside water from directly entering the inside 301*a* of the motor 301 through the vent hole 327 and the drain hole 332. That is, the space 319 acts as a kind of damper for ensuring a good water resistance.

In the event that the outside water enters the inside 301*a* of the motor 301, the water is quickly expelled from the drain hole 325 into the space 319 owing to the vent hole 326 communicated through the vent hole 327 to the atmosphere, and is then expelled from the drain hole 332 to the outside owing to the vent hole 327 communicated with the atmosphere.

Further, since the vent hole 327 and the drain hole 332 are formed on the engaged surface between the throttle housing 314 and the end cover 308, the water if entering through the vent hole 327 into the space 319 drops along the engaged surface and it is quickly expelled through the drain hole 332 to the outside. Further, if the inner wall of the space 319 is dewed, the drops of dew is lowered along the engaged surface and it is quickly expelled through the drain hole 332, thus ensuring a good drainage performance.

As the groove 328 has a substantially Z-shaped configuration having the stepped portion 329, the entry of the outside water through the vent hole 327 into the space 319 is more effectively prevented than a straight groove.

Figure 10:
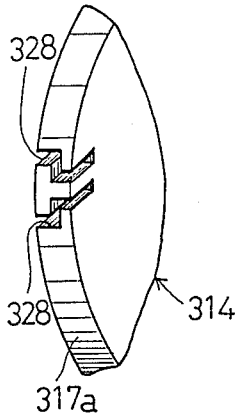
FIGS. 10 to 16 are perspective views of modifications of a groove formed on the mount surface of the throttle housing.
Figure 11:
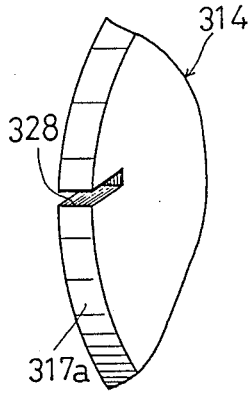
Figure 12:
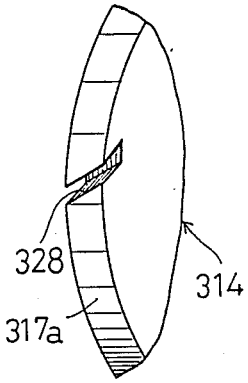
Figure 13:
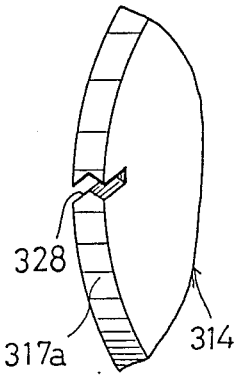
Figure 14:
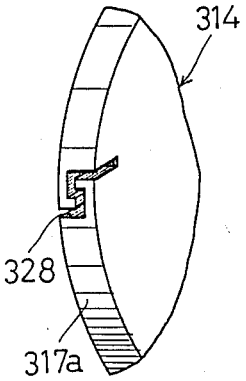
Figure 15:
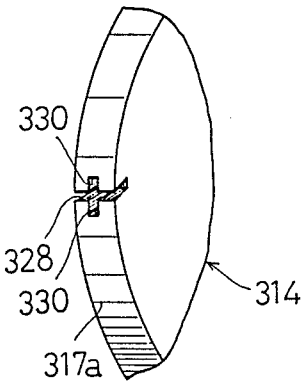
Figure 16:
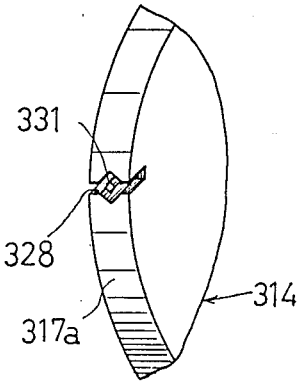
Figure 17A:
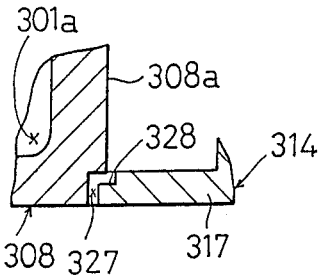
FIGS. 17A, 18A, 19A, 20A and 21A are sectional views of modifications of the groove formed at an engaged portion between the end cover and the throttle housing.
Figure 17B:
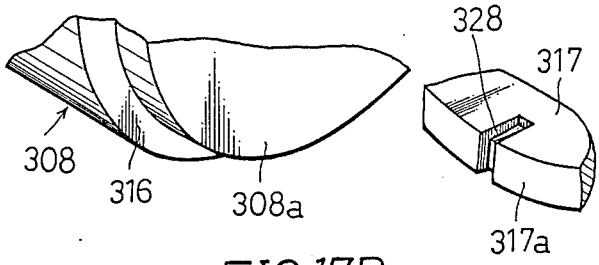
FIGS. 17B, 18B, 19B, 20B and 21B are exploded perspective views of FIGS. 17A to 21A, respectively.
Figure 18A:
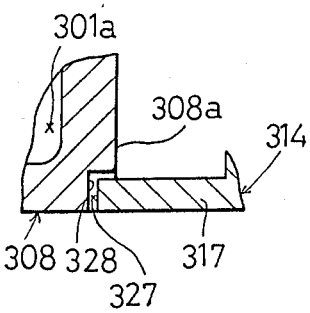
Figure 18B:
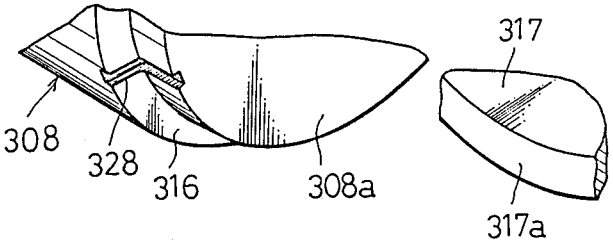
Figure 19A:
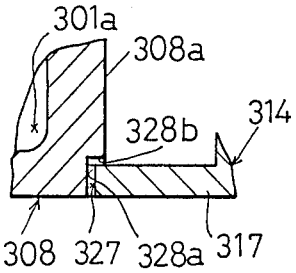
Figure 19B:
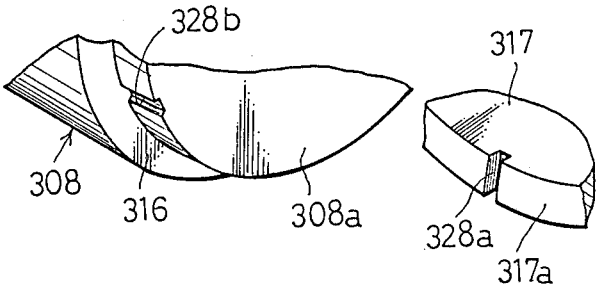
Figure 20A:
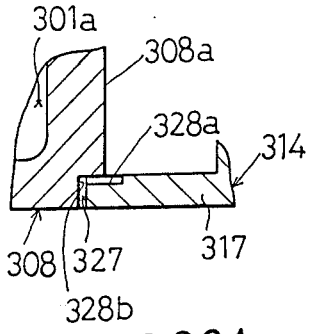
Figure 20B:
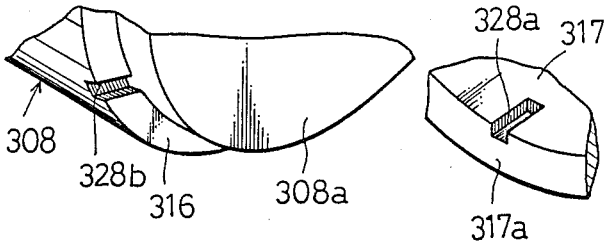
Figure 21A:
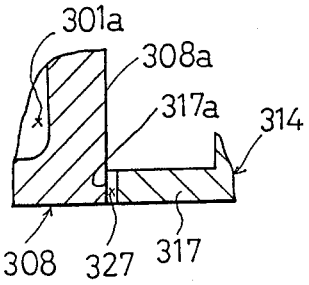
Figure 21B:
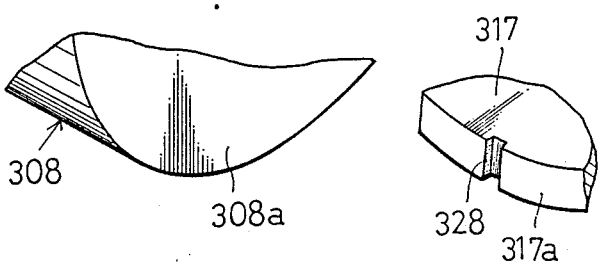

FIGS. 10 to 16 show various modifications of the groove 328 for the vent hole 327. Referring to FIG. 10, a pair of substantially Z-shaped grooves 328 are formed in juxtaposed relationship to each other on the end surface 317*a* of the flange 317, so that the venting performance of the vent hole 327 may be improved to thereby improve the drainage performance of the drain hole 332. The groove 328 may have other shapes such as horizontally straight (FIG. 11), obliquely straight (FIG. 12), V-shaped (FIG. 13), labyrinth-like (FIG. 14), cross-like (FIG. 15) and diamond (FIG. 16). Especially, as shown in FIG. 15, the groove 328 is branched into vertical recesses 330 for catching the entering water through the vent hole 327 by capillarity. Further, as shown in FIG. 16, the diamond groove 328 is formed at its center with a projection 331 acting as an obstruction against the entering water. Referring to FIGS. 17A and 17B, the groove 328 formed at the end surface 317*a* of the flange 317 is of a substantially L-shape. Referring to FIGS. 18A and 18B, the substantially L-shaped groove 328 is formed on the mount surface 308*a* of the end cover 308. Referring to FIGS. 19A and 19B, a straight groove 328*a* exposed to the atmosphere is formed on the end surface 317*a* of the flange 317, while a straight groove 328*b* exposed to the space 319 is formed on the mount surface 308*a* of the end cover 308. Both the straight grooves 328*a* and 328*b* are combined to form a substantially L-shaped groove 328. In contrast, referring to FIGS. 20A and 20B, a straight groove 328*a* exposed to the space 319 is formed on the inside surface of the flange 317, while a straight groove 328*b* exposed to the atmosphere is formed on the mount surface 308*a* of the end cover 308. Thus, both the straight grooves 328*a* and 328*b* are combined to form the substantially L-shaped groove 328. Further, the mount surface 308*a* of the end cover 308 may be formed into a flat surface. In this structure, the groove 328 formed on the end surface 317*a* of the flange 317 may have a less depth, resulting in easy fabrication of the groove 328.

Although the vent hole 326 is singly provided at the top position of the end cover 308, and the vent hole 327 is singly provided at the side position of the engaged portion between the end cover 308 and the throttle housing 314 in the above preferred embodiment, the position and the number of the vent holes 326 and 327 are not limited to the above preferred embodiment, provided that the vent holes 326 and 327 are required to be located over the drain holes 325 and 332, respectively. Moreover, the motor 301 is not limited to the step motor according to the present invention.

The groove 328 of the vent hole 327 and the groove 333 of the drain hole 332 may be formed by metal molding of the end cover 308 or the throttle housing 314, so as to reduce the manufacturing cost, however, they may be formed by cutting.

Figure 22:
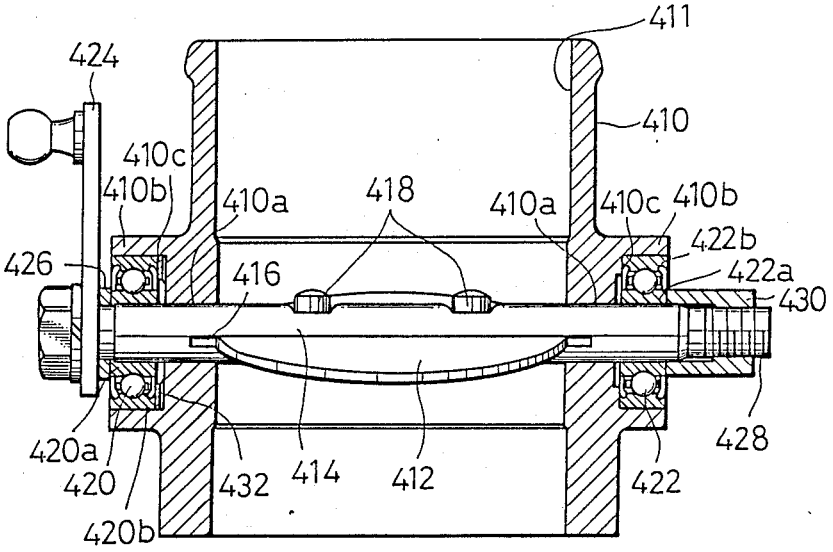
FIG. 22 is a sectional view of the throttle shaft supporting structure according to the fourth aspect of the present invention.
Figure 23:
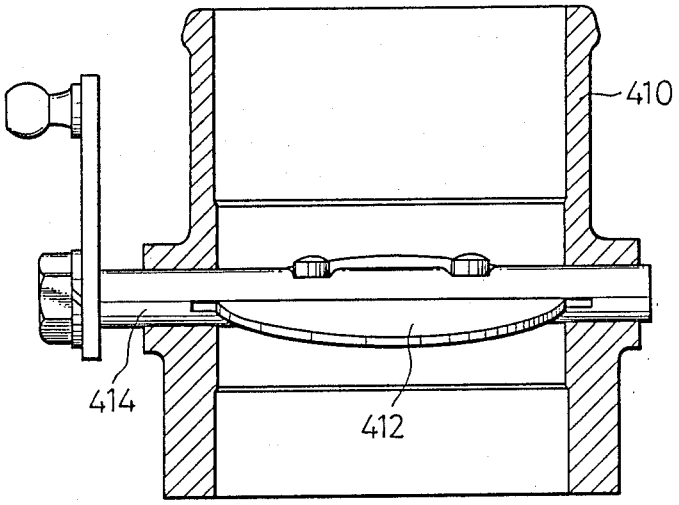
FIG.23 PRIOR ART
FIG. 23 is a sectional view of the throttle shaft supporting structure in the prior art.

Referring to FIG. 22 which shows a preferred embodiment according to the fourth aspect of the present invention, reference numeral 410 designates a throttle housing to be installed in a suction system of an internal combustion engine. The throttle housing 410 is formed at its opposite side walls with a pair of through-holes 410*a* for inserting a throttle shaft 414 and with a pair of cylindrical bearing housings 410*b* for receiving a pair of ball bearings 420 and 422. The throttle shaft 414 extends across a suction passage 411 in perpendicular relationship thereto. A throttle valve 412 is inserted into a slit 416 formed through the throttle shaft 414, and is fixed thereto by a pair of screws 418.

The ball bearings 420 and 422 are mounted on opposite end portions of the throttle shaft 414 projecting out of the opposite walls of the throttle housing 410, so that the throttle shaft 414 is rotatably supported through the ball bearings 420 and 422 to the throttle housing 410. A throttle lever 424 is fixed to one of the end portions of the throttle shaft 414, and a return spring (not shown) is engaged with the other end portion. The ball bearing 420 includes an inner ring 420*a* and an outer ring 420*b*, while the right ball bearing 422 includes an inner ring 422*a* and an outer ring 22*b*. The inner ring 420*a* of the left ball bearing 420 is loosely fitted to the throttle shaft 414, and it is abuttable against an annular spacer (first abutment portion) 426 fixedly mounted on the throttle shaft 414 inside (on the right side as viewed in FIG. 22)

of the throttle lever 424. The first abutment portion 426 may be formed as an increased-diameter portion of the throttle shaft 414. Similarly, the inner ring 422*a* of the right ball bearing 422 is also loosely fitted to the throttle shaft 414, and it is abuttable against an adjust screw (second abutment portion) 430 threadedly engaged with a threaded portion 428 formed at the right end of the throttle shaft 414.

The outer rings 420*b* and 422*b* of the ball bearings 420 and 422 are also loosely fitted to the inner circumference of the bearing housings 410*b*, and they are abuttable against opposite inside wall surfaces 410*c* of the bearing housings 410*b* perpendicular to the throttle shaft 414. The inside wall surfaces 410*c* of the bearing housings 410*b* are oriented outwardly and opposed to the abutment portions 426 and 430. A spring 432 of a wave washer is interposed between the outer ring 420*b* of the left ball bearing 420 and the left inside wall surface 410*c* opposed to the outer ring 420*b*. The wave washer is preferable since it can be located in a narrower space as compared with a coil spring, and it can endure a large compression load.

In operation, when the adjust screw 430 is driven to move the inner ring 422*a* of the right ball bearing 422 leftwardly as viewed in FIG. 22, the outer ring 422*b* is also moved leftwardly to abut against the inside wall surface 410*c* of the right bearing housing 410*b*. When the adjust screw 430 is further driven, the throttle shaft 414 is moved rightwardly. As a result, the spacer 426 urges the inner ring 420*a* of the left ball bearing 420 rightwardly. At the same time, a tightening force of the adjust screw 430 is transmitted through the inner ring 420*a* to the outer ring 420*b*. Accordingly, a set load of the spring 432 may be adjusted by the adjust screw 430. The set load of the spring 432 is applied to the inner ring 420*a* and the outer ring 420*b* to maintain axial slippage between the inner ring 420*a* and the outer ring 420*b*. Similarly, as the set load is also transmitted to the right ball bearing 422 to exhibit the same effect. The set load is so adjusted as to absorb dimensional error of the elements and prevent the axial movement of the throttle shaft 414 and ensure smooth rotation of the ball bearings 420 and 422.

As the ball bearings 420 and 422 are loosely fitted between the throttle shaft 414 and the bearing housing 410*b*, it is not necessary to form a stepped portion on the throttle shaft in the case of press-fitting the inner ring to the throttle shaft. Accordingly, working of the throttle shaft may be simplified.

Further, if one of the outer rings is press-fitted, and the other is loosely fitted, it will be necessary to exchange a working tool. However, the preferred embodiment eliminates such exchange of the working tool to improve the accuracy of working (alignment and roundness of the bearing housings).

In the case of press-fitting the bearings, the pressfit between the bearings and the throttle housing is loosened because of a difference in temperatures of the bearings and the throttle housing, causing deflection of the wave washer to move the throttle shaft. As a result, the throttle valve bites the throttle housing in operation. If the interference is increased to eliminate the loosening due to the difference in temperatures, the bearings will be deformed since the interference depends on the using conditions of the bearings, causing unsmooth rotation of the bearings. To the contrary, according to the preferred embodiment, the inner rings and the outer rings of both the bearings are loosely fitted, the throttle shaft is desirably positioned by the spring upon mounting of the throttle valve, and the movement of the throttle shaft is therefore prevented during operation.

Figure 24:
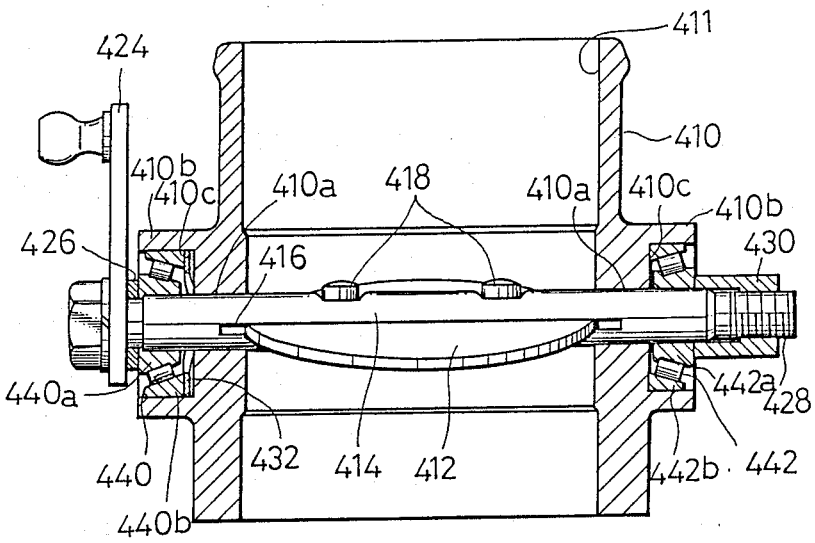
FIG. 24 is a sectional view of a modification of the supporting structure shown in FIG. 22.

FIG. 24 shows another preferred embodiment of the fourth aspect of the present invention, wherein roller bearings 440 and 442 are substituted for the ball bearings 420 and 422 in the first preferred embodiment shown in FIG. 22, and the other construction is the same as the first preferred embodiment.

Figure 25:
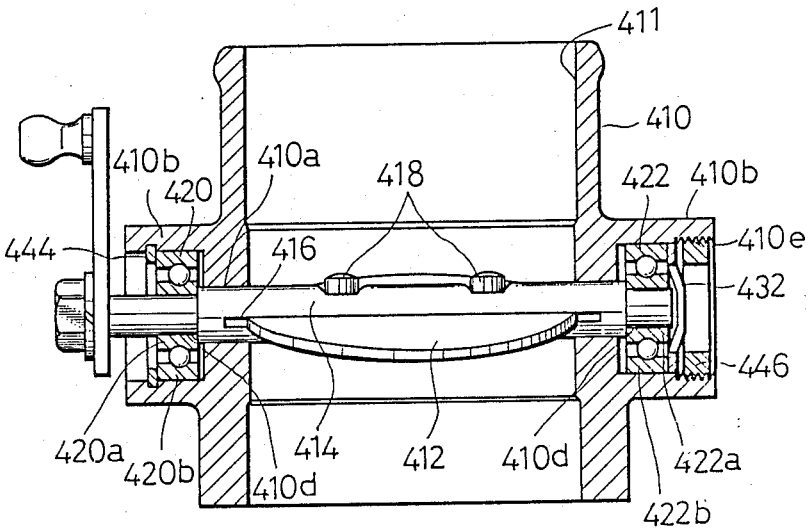
FIG. 25 is a sectional view of another modification of the supporting structure shown in FIG. 22.

Referring to FIG. 25 which shows a modification of the first preferred embodiment, the throttle shaft 414 is formed at its opposite end portions with a pair of shoulders 410*d* acting as the abutment portions against the inner rings 420*a* and 422*a* of the ball bearings 420 and 422. A snap ring 444 acting as a first engagement portion against the outer ring 420*b* of the left ball bearing 420 is fitted to an annular groove formed on the inner circumference of the left bearing housing 410*b* of the throttle housing 410, while an adjust screw 446 acting as a second engagement portion against the outer ring 422*b* of the right ball bearing 422 is threadedly engaged with an internal thread 410*e* formed on the inner circumference of the right bearing housing 410*b*. A spring 432 of a wave washer is interposed between the adjust screw 446 and the outer ring 422*b* of the right ball bearing 422.

In operation, when the adjust screw 446 is tightened to urge the spring 432, the outer ring 422*b* of the right ball bearing 422 is urged by the spring 432. Accordingly, the spring force is transmitted through the inner ring 422*a* of the right ball bearing 422 and the throttle shaft 414 to the inner ring 420*a* of the left ball bearing 420. However, as the outer ring 420*b* of the left ball bearing 420 is engaged with the snap ring 444, the leftward movement of the inner ring 420*a* is restricted. Accordingly, a predetermined spring force of the spring 432 is applied between the inner ring 420*a* and the outer ring 420*b* of the left ball bearing 420. Similarly, a predetermined spring force of the spring 432 is also applied between the inner ring 422*a* and the outer ring 422*b* of the right ball bearing 422.

Having thus described the preferred embodiment of the invention, it should be understood that numerous structural modifications and adaptations may be made without departing from the spirit of the invention.

What is claimed is:

1. A throttle valve comprising:

(a) a first outer peripheral portion linearly contacting an inner wall of a suction passage at a predetermined throttle angle; and (b) a second outer peripheral portion formed in the vicinity of a throttle shaft in such a manner as to gently continue from said first outer peripheral portion and not contacting said inner wall.

2. The throttle valve as defined in claim 1, wherein said first outer peripheral portion forms elliptical sections linearly contacting said inner wall of said suction passage having a circular cross section, and said second outer peripheral portion forms elliptical sections having a minor axis smaller than that of said elliptical sections of said first outer peripheral portion in an axial direction of said throttle shaft.

3. A method of forming a throttle valve to be installed in a suction passage having a circular cross section, comprising:

(a) a first cutting step of cutting a plate along a first cylindrical cutting plane under the condition where said plate is inclined at a first predetermined angle relative to an axis of said first cylindrical cutting plane; and (b) a second cutting step of cutting said plate obtained in said first cutting step along a second cylindrical cutting plane having an inner diameter smaller than said first cylindrical cutting plane under the condition where said plate is inclined at a second predetermined angle greater than said first predetermined angle.

4. A throttle body comprising:

(a) a throttle housing defining a suction passage therein;

(b) a throttle shaft extending across said suction passage to the outside of said throttle housing at at least one end thereof and being rotatably supported to said throttle housing;

(c) a throttle valve fixed to said throttle shaft for opening and closing said suction passage;

(d) a sectoral driven gear fixed to the one end portion of said throttle shaft outside said throttle housing, said driven gear having a pair of stopper end surfaces;

(e) a motor fixed to said throttle housing and having an output shaft mounting a drive gear thereon meshing with said driven gear of said throttle shaft;

(f) a gear receiving chamber closely defined by said motor and said throttle housing for receiving said drive gear and said driven gear; and (g) a pair of adjust screws threadedly inserted through a wall of said gear receiving chamber and being abuttable against said pair of stopper end surfaces of said sectoral driven gear; wherein when said motor is driven to rotate said driven gear through said drive gear to a full open position or a full closed position, further rotation of said throttle valve exceeding said full open position or said full closed position is restricted.

5. A throttle body comprising:

(a) a throttle housing defining a suction passage therein;

(b) a throttle shaft extending across said suction passage and being rotatably supported to said throttle housing;

(c) a throttle valve fixed to said throttle shaft for opening and closing said suction passage:

(d) a motor fixed to said throttle housing for rotating said throttle shaft;

(e) a gear receiving chamber defined by said motor and said throttle housing;

(f) a first drain hole formed at a lower position of said motor to communicate the inside of said motor with said gear receiving chamber;

(g) a first vent hole formed at a position higher than said first drain hole to communicate the inside of said motor with said gear receiving chamber;

(h) a second drain hole formed at a bottom of an engaged portion between said motor and said throttle housing to communicate said gear receiving chamber with the atmosphere; and (i) a second vent hole formed at a position higher than said second drain hole to communicate said gear receiving chamber with the atmosphere.

6. A throttle body comprising:

(a) a throttle housing defining a suction passage therein;

(b) a throttle shaft extending across said suction passage and being rotatably supported to said throttle housing;

(c) a pair of bearings for rotatably supporting said throttle shaft to opposite wall portions of said throttle housing, each said bearing having an inner ring loosely fitted to said throttle shaft and an outer ring loosely fitted to said throttle housing;

(d) a throttle valve fixed to said throttle shaft for opening and closing said suction passage:

(e) a pair of abutment portions provided at opposite end portions of said throttle shaft in such a manner as to abut against said inner rings of said bearings;

(f) a pair of engagement portions provided at the opposite wall portions of said throttle housing in such a manner as to engage said outer rings of said bearings;

(g) a spring interposed between at least one of said outer rings and said engagement portion opposed thereto; and (h) an adjusting means for adjusting at least one of said abutment portions or at least one of said engagement portions in the axial direction of said throttle shaft.

* * * * *